US010407241B1

(12) United States Patent
Hipp

(10) Patent No.: US 10,407,241 B1
(45) Date of Patent: Sep. 10, 2019

(54) DUMPSTER WITH SLIDING CLOSURE

(71) Applicant: David Hipp, Lyman, SC (US)

(72) Inventor: David Hipp, Lyman, SC (US)

( * ) Notice: Subject to any disclaimer, the term of this patent is extended or adjusted under 35 U.S.C. 154(b) by 349 days.

(21) Appl. No.: 15/444,383

(22) Filed: Feb. 28, 2017

(51) Int. Cl.
*B30B 9/30* (2006.01)
*B65F 3/14* (2006.01)
*B65F 3/20* (2006.01)
*B65F 1/14* (2006.01)

(52) U.S. Cl.
CPC ..... *B65F 1/1405* (2013.01); *B30B 9/3042* (2013.01); *B65F 1/1468* (2013.01); *B65F 3/14* (2013.01)

(58) Field of Classification Search
CPC ..... B30B 9/3042; B30B 9/3046; B65F 1/002; B65F 1/1405; B65F 1/1468; B65F 3/14
See application file for complete search history.

(56) References Cited

U.S. PATENT DOCUMENTS 3,513,771 A * 5/1970 Felts ..... B30B 9/3042 100/215
4,152,979 A 5/1979 Schmidt
D290,591 S 6/1987 Shirvanian
4,726,616 A 2/1988 Schmidt
5,816,145 A * 10/1998 Lackner ..... B30B 9/3042 100/208
5,897,014 A 4/1999 English
6,296,132 B1 10/2001 Pickler
7,008,001 B1 3/2006 Reynolds
7,083,060 B2 8/2006 Pickier
2015/0232271 A1* 8/2015 Sundholm ..... B65F 1/105 100/90

FOREIGN PATENT DOCUMENTS

CA 1087136 A 10/1980
DE 3629846 A1 * 3/1988 ..... E06B 3/483
FR 2304554 A1 * 10/1976 ..... B30B 9/3042
FR 2463734 A1 * 2/1981 ..... B30B 9/3007
GB 1190436 A * 5/1970 ..... B30B 9/3042
GB 2083777 A * 3/1982 ..... B30B 9/3032

* cited by examiner

*Primary Examiner* — Jimmy T Nguyen
(74) *Attorney, Agent, or Firm* — Kyle A. Fletcher, Esq.

(57) ABSTRACT

The roll-off dumpster includes a hinged door at a front end of the roll-off dumpster. The hinged door is able to open and close off a front opening of the roll-off dumpster. The hinged door includes a sliding closure that is able to operate independently of the hinged door. Moreover, the sliding closure includes a winch that raises a sliding door vertically. The sliding door is able to move up and down with respect to a pair of rails integrated into the construction of the hinged door. The sliding door is raised vertically to expose a front closure opening that is configured to interface with an outlet of a stationary compactor.

16 Claims, 6 Drawing Sheets

DUMPSTER WITH SLIDING CLOSURE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of dumpsters and trash bins, more specifically, a sliding closure integrated into a roll-off dumpster.

Roll-off dumpsters are well known in the commercial and industrial world. A particular version of a roll-off dumpster is only accessible from a door provided on a front surface of the roll-off dumpster. The door being provided on the front surface of the roll-off dumpster has shortcomings. One such shortcoming is that when the roll-off dumpster is filled with a compacted debris or trash, closing the door may be difficult because the compacted debris or trash is falling out of the opening at the door of the roll-off dumpster. Moreover, the compacted debris or trash may fall onto the ground making a mess that requires labor to address. This problem is especially prevalent where the roll-off dumpster is particularly used for a stationary compactor.

What is needed is a roll-off dumpster that is able to interface with the stationary compactor, and when the roll-off dumpster is filled, a sliding closure will seal off the front opening upon removal of the roll-off dumpster with respect to the stationary compactor. The device of the present application addresses this need in a new and not obvious manner.

SUMMARY OF INVENTION

The dumpster with sliding closure is a roll-off dumpster wherein a first end includes a sliding closure that interfaces with a stationary compactor. The roll-off dumpster is temporarily positioned adjacent to the stationary compactor such that the stationary compactor is able to insert compacted debris directly into the roll-off dumpster. Once the roll-off dumpster is filled with compacted debris, the roll-off dumpster is rolled away from the stationary compactor. At this point in time, the sliding closure will drop down to close off the interior of the roll-off dumpster such that compacted debris is unable to escape the roll-off dumpster.

The roll-off dumpster includes a hinged door at a front end of the roll-off dumpster. The hinged door is able to open and close off a front opening of the roll-off dumpster. The hinged door includes a sliding closure that is able to operate independently of the hinged door. Moreover, the sliding closure includes a winch that raises a sliding door vertically. The sliding door is able to move up and down with respect to a pair of rails integrated into the construction of the hinged door. The sliding door is raised vertically to expose a closure opening that is configured to interface with an outlet of a stationary compactor.

The winch is controlled via a control box. When the roll-off dumpster is filled to capacity, the winch releases the sliding door such that upon separation of the outlet of the stationary compactor with respect to the closure opening of the roll-off dumpster, the sliding door lowers in order to seal off the interior of the roll-off dumpster. Sealing off the interior of the roll-off dumpster prevents compacted debris or trash from falling out of the roll-off dumpster.

These together with additional objects, features and advantages of the dumpster with sliding closure will be readily apparent to those of ordinary skill in the art upon reading the following detailed description of the presently preferred, but nonetheless illustrative, embodiments when taken in conjunction with the accompanying drawings.

In this respect, before explaining the current embodiments of the dumpster with sliding closure in detail, it is to be understood that the dumpster with sliding closure is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the dumpster with sliding closure.

It is therefore important that the claims be regarded as including such equivalent construction insofar as they do not depart from the spirit and scope of the dumpster with sliding closure. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
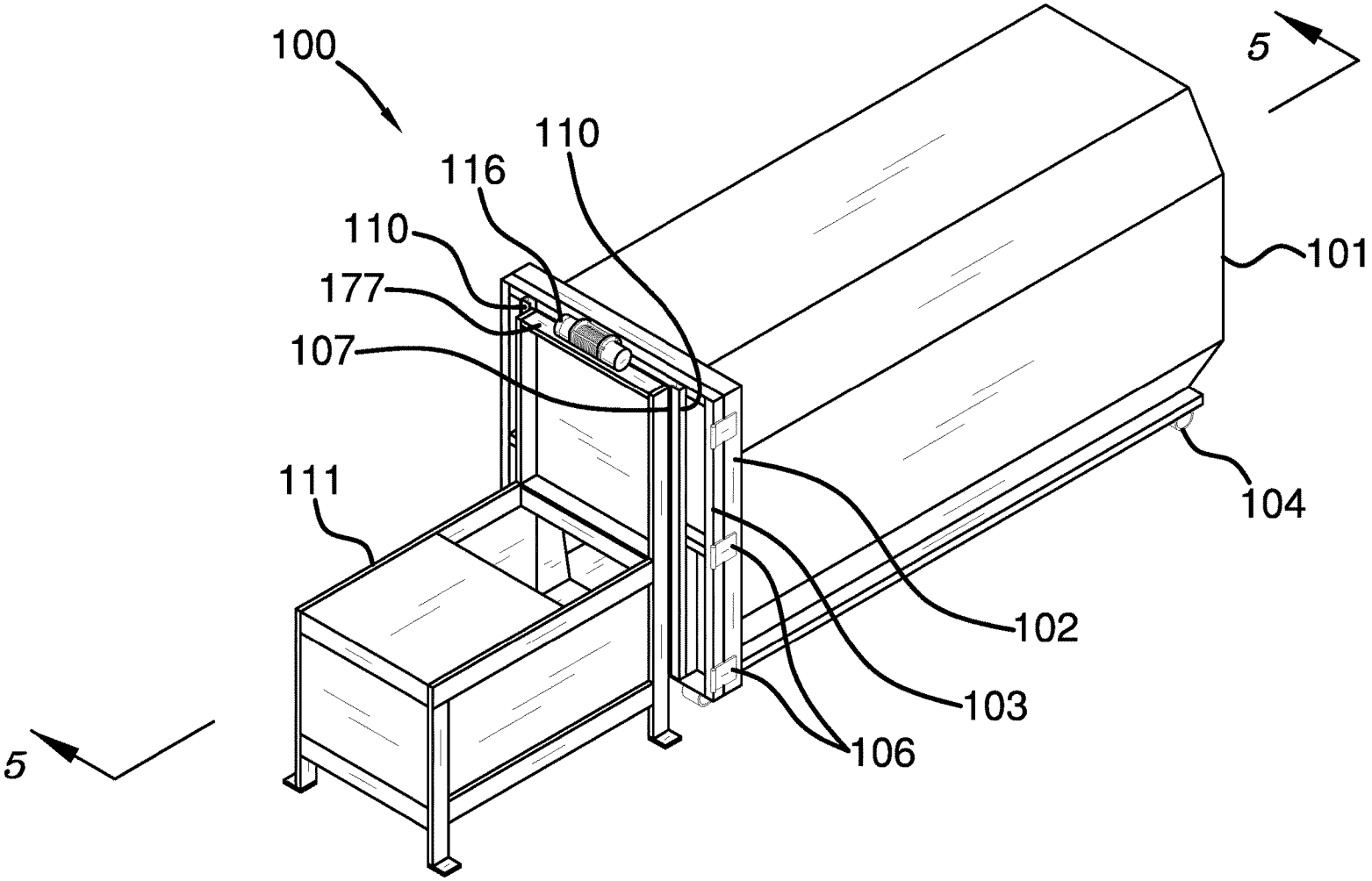
FIG. 1 is a perspective view of an embodiment of the disclosure.
Figure 2:
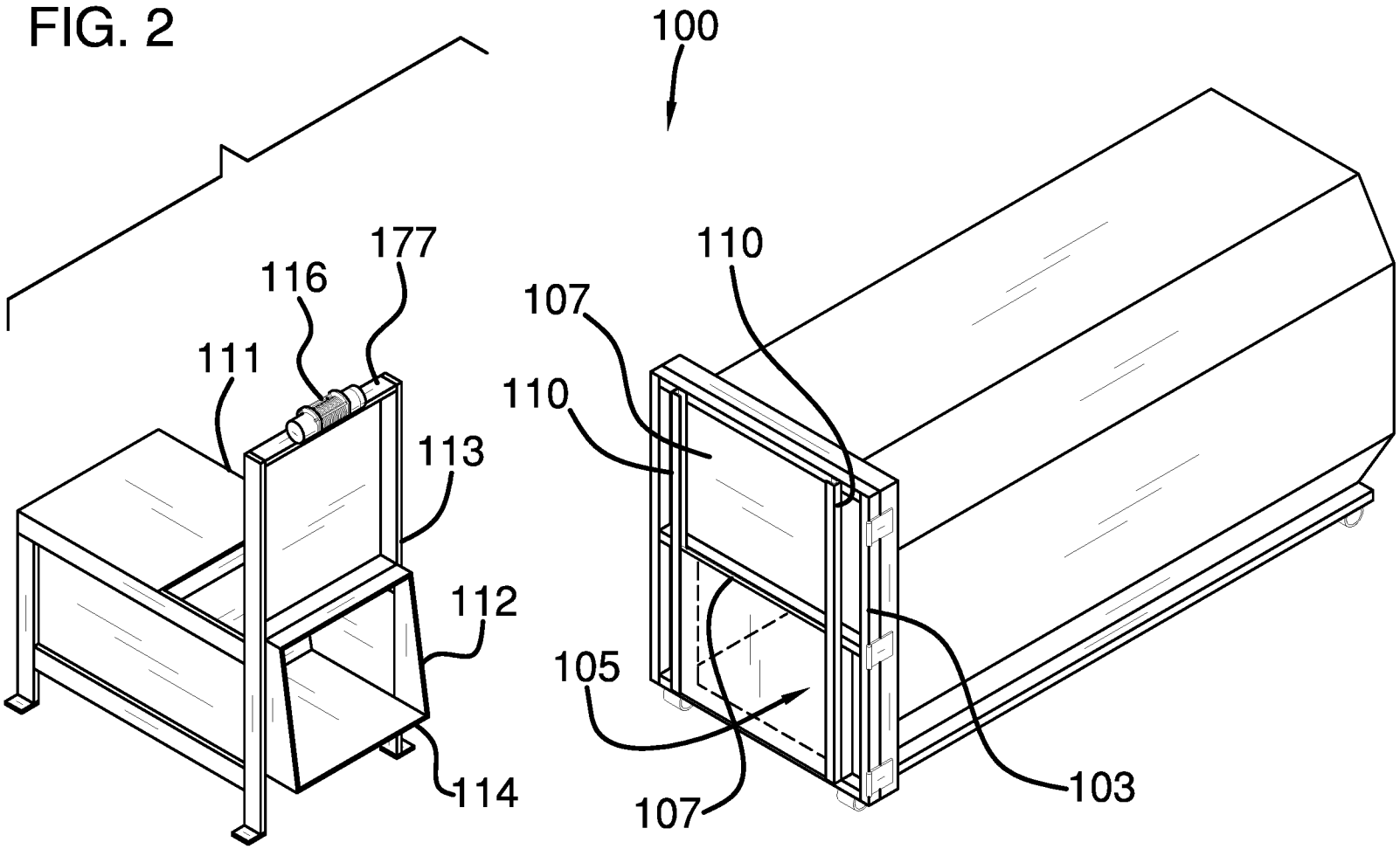
FIG. 2 is another perspective view of an embodiment of the disclosure.
Figure 3:
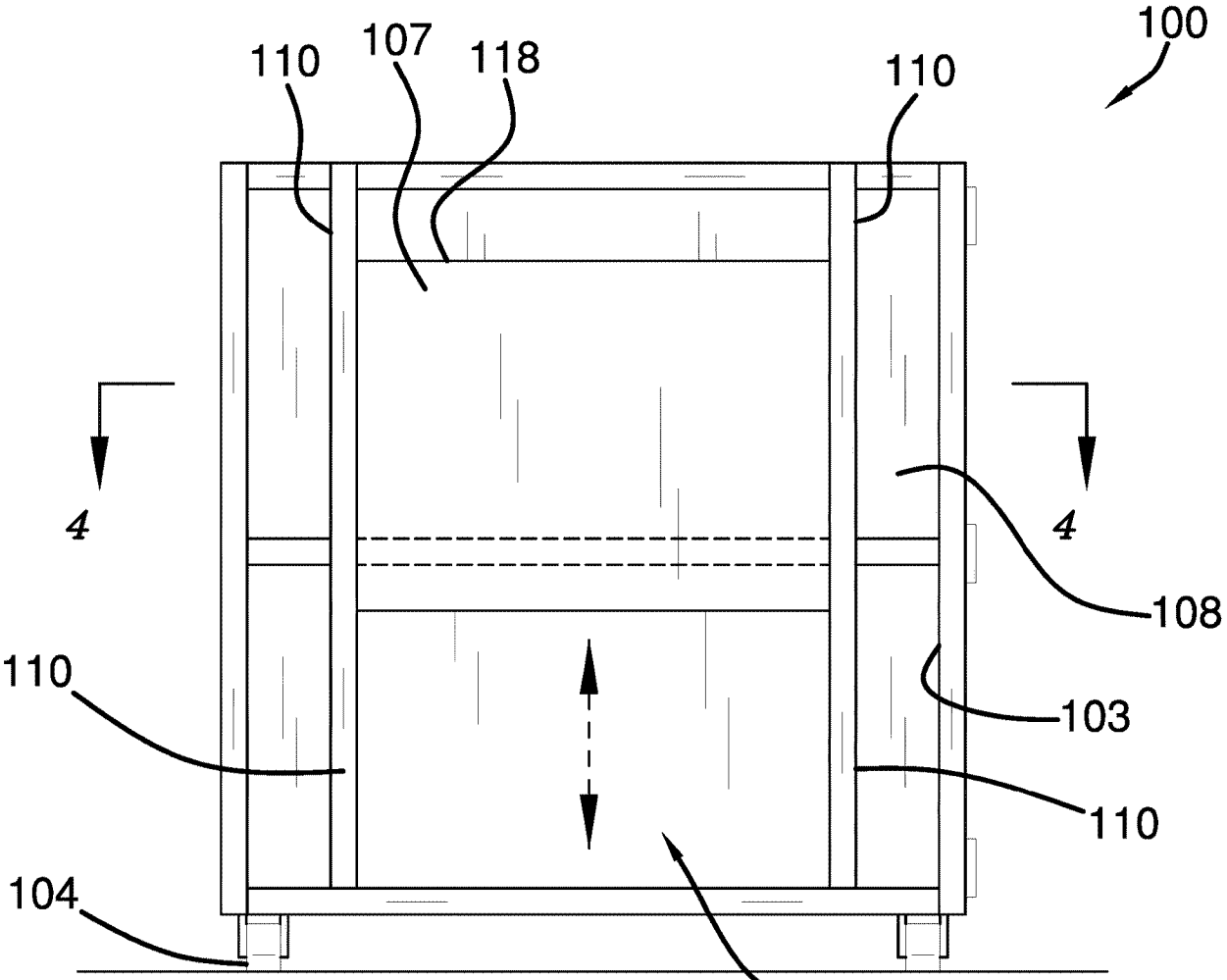
FIG. 3 is a front view of an embodiment of the disclosure.
Figure 4:
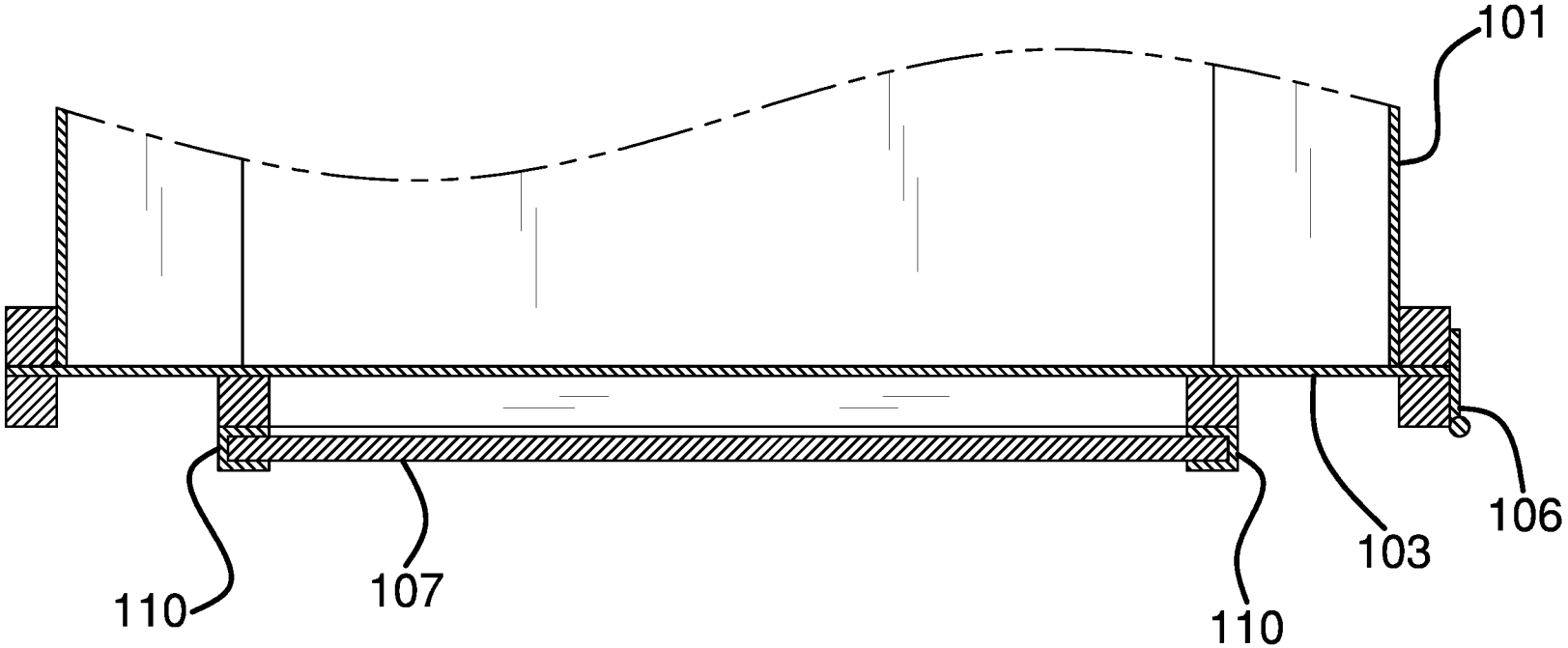
FIG. 4 is a cross-sectional view of an embodiment of the disclosure along line 4-4 in FIG. 3.
Figure 5:
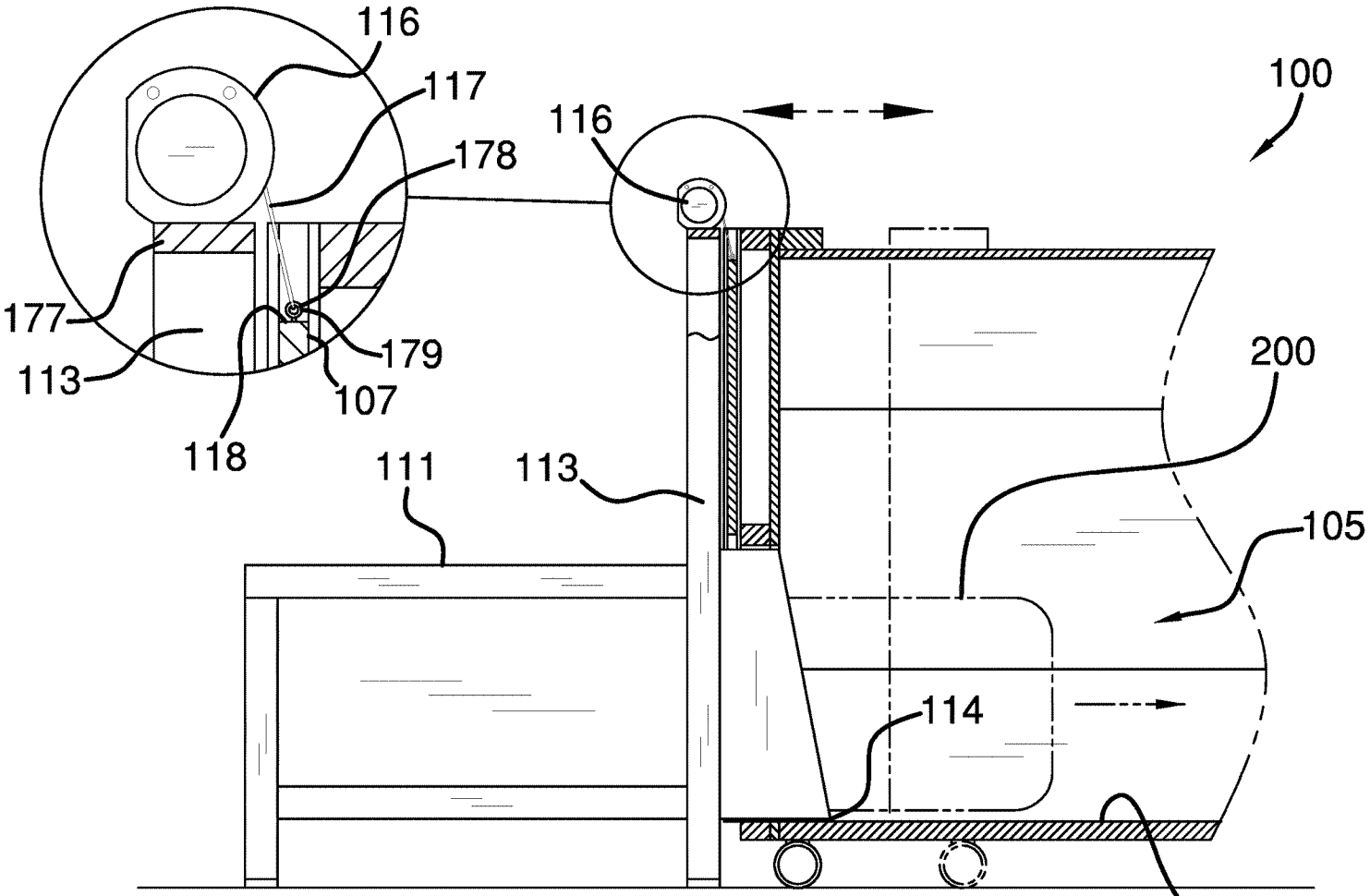
FIG. 5 is a cross-sectional view of an embodiment of the disclosure along line 5-5 in FIG. 1.
Figure 6:
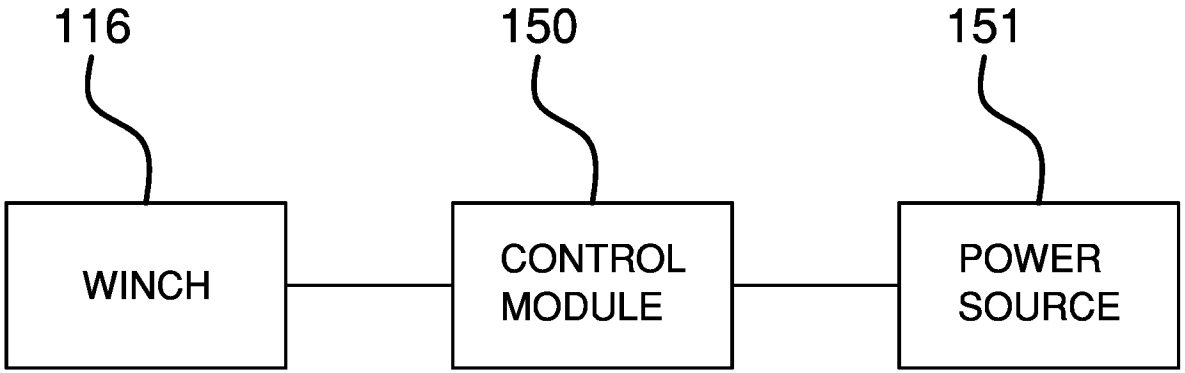
FIG. 6 is a block diagram of componentry associated with an embodiment of the disclosure.

Detailed reference will now be made to one or more potential embodiments of the disclosure, which are illustrated in FIGS. 1 through 6.

The dumpster with sliding closure 100 (hereinafter invention) comprises a roll-off dumpster 101 that is further defined with a front end 102. A hinged door 103 is provided at the front end 102 of the roll-off dumpster 101. It shall be noted that the roll-off dumpster 101 includes wheels 104, and is enclosed along a top and sides. The only way to gain access to an interior 105 of the roll-off dumpster 101 is via the hinged door 103 at the front end 102. The hinged door 103 pivots with respect to the front end 102 via hinges 106. The hinged door 103 rotates outwardly with respect to the roll-off dumpster 101 in order to expose the interior 105 of the roll-off dumpster 101.

The hinged door 103 includes an improvement that is unique over traditional roll-off dumpsters. The hinged door 103 includes a sliding door 107 that is able to move up and down. Moreover, the hinged door 103 is further defined with an outer surface 108. The sliding door 107 is adjacent to and moves up and down with respect to the outer surface 108 of the hinged door 103. The hinged door 103 has a closure opening 109 that is exposed when the sliding door 107 is raised vertically.

The hinged door 103 includes a pair of rails 110 that enables the sliding door 107 to raise up and down with respect to the hinged door 103. The pair of rails 110 are affixed to the outer surface 108 of the hinged door 103. The pair of rails 110 are generally parallel with one another. Moreover, the pair of rails 110 are constructed of "C" channel structure, and face one another. The pair of rails 110 extend vertically with respect to the hinged door 103.

The closure opening 109 enables the roll-off dumpster 101 to interface with a stationary compactor 111. The roll-off dumpster 101 is configured to be positioned and interface with the stationary compactor 111. More specifically, the closure opening 109 enables the stationary compactor 111 to insert compacted material 200 into the interior 105 of the roll-off dumpster 101. The stationary compactor 111 includes an outlet 112 that is configured to be partially inserted into the closure opening 109 in order to insert compacted material into the interior 105 of the roll-off dumpster 101. The stationary compactor 111 is further defined with a front frame 113 that is located aft of the outlet 112. The front frame 113 is configured to be placed against the hinged door 103.

The outlet 112 of the stationary compactor 111 is angled, vertically speaking. A lower edge 114 of the outlet 112 is farthest from the front frame 113. The lower edge 114 of the outlet 112 is configured to be positioned on a floor surface 115 of the interior 105 of the roll-off dumpster 101. The outlet 112 has said angle formed in order to interface with the sliding door 107 such that as the roll-off dumpster 101 is pulled away, the sliding door 107 is able to move downwardly as the outlet 112 is withdrawn from the interior 105 of the roll-off dumpster 101.

The sliding door 107 is able to move up or down via a winch 116. A winch cable 117 winds on the winch 116. The winch cable 117 is affixed to a top door surface 118 of the sliding door 107 in order to raise up or lower down the sliding door 107 with respect to the hinged door 103 thereby exposing or sealing off the closure opening 109 of the hinged door 103.

The front frame 113 extends vertically above the stationary compactor 111. The front frame 113 is further defined with a top frame 177. The winch 116 is mounted on the top frame 177 of the front frame 113. The winch cable 117 includes a hoop 178 that attaches to an eyelet 179 affixed to the sliding door 107. The eyelet 179 of the sliding door 107 is located on the top surface 118 such that the winch cable 117 is able to pull the sliding door 107 upwardly, and upon releasing of the winch cable 117 via the winch 116, the sliding door 107 is able to drop. This configuration enables the winch cable 117 to be disconnected from the sliding door 107 when the roll-off dumpster 101 is to be taken away from the stationary compactor 111.

The winch 116 is wired to a control module 150, which in turn is wired to a power source 151. The control module 150 may be wired to different componentry that aid in determining an appropriate timing of operation of the winch 116. For example, as the interior 105 of the roll-off dumpster 101 nears full capacity with compacted material via the stationary compactor 111, the control module 150 will close the sliding door 107. Upon doing so, the angle formed on the outlet 112 of the stationary compactor 111 would complement movement of the sliding door 107. Moreover, the roll-off dumpster 101 would move in concert with these interactions.

The power source 151 may be a battery, a bank of batteries, or a power cord that plugs into a standard electrical outlet. The control module 150 may be an electrical device that is programmable and that accepts digital and analog inputs, processes the digital and analog inputs according to previously stored instruction and provides the results of these instructions as digital or analog outputs. The roll-off dumpster 101, the hinged door 103, the sliding door 107, the pair of rails 110, and other componentry associated therewith is ideally constructed of metal.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A dumpster comprising:

a roll-off dumpster that is configured to be positioned against and interface with a stationary compactor in order to receive compacted material;

wherein once the roll-off dumpster is filled to capacity with compacted material, the roll-off dumpster is removed from said stationary compactor, and a sliding door of the roll-off dumpster is able to close off a closure opening in order to prevent spillage of said compacted material from the roll-off dumpster;

wherein the roll-off dumpster is further defined with a front end;

wherein a hinged door is provided at the front end of the roll-off dumpster;

wherein the stationary compactor includes an outlet that is configured to be partially inserted into the closure opening in order to insert compacted material into the interior of the roll-off dumpster;

wherein the stationary compactor is further defined with a front frame that is located aft of the outlet;

wherein the front frame is configured to be placed against the hinged door;

wherein the outlet of the stationary compactor has an angle that extends upwardly;

wherein a lower edge of the outlet is farthest from the front frame;

wherein the lower edge of the outlet is configured to be positioned on a floor surface of the interior of the roll-off dumpster;

wherein the outlet has said angle formed in order to interface with the sliding door such that as the roll-off dumpster is pulled away, the sliding door is able to move downwardly as the outlet is withdrawn from the interior of the roll-off dumpster.

2. The dumpster according to claim 1 wherein the roll-off dumpster includes wheels, and is enclosed along a top and sides; wherein the only way to gain access to the interior of the roll-off dumpster is via the hinged door at the front end.

3. The dumpster according to claim 2 wherein the hinged door pivots with respect to the front end via hinges; wherein the hinged door rotates outwardly with respect to the roll-off dumpster in order to expose the interior of the roll-off dumpster.

4. The dumpster according to claim 3 wherein the hinged door includes the sliding door thereon; wherein the sliding door is able to move up and down irrespective of the hinged door.

5. The dumpster according to claim 4 wherein the hinged door is further defined with an outer surface; wherein the sliding door is adjacent to and moves up and down with respect to the outer surface of the hinged door.

6. The dumpster according to claim 5 wherein the hinged door has the closure opening that is exposed when the sliding door is raised vertically.

7. The dumpster according to claim 6 wherein the hinged door includes a pair of rails that enables the sliding door to raise up and down with respect to the hinged door.

8. The dumpster according to claim 7 wherein the pair of rails are affixed to the outer surface of the hinged door; wherein the pair of rails are generally parallel with one another.

9. The dumpster according to claim 8 wherein the pair of rails are constructed of "C" channel structure, and face one another; wherein the pair of rails extend vertically with respect to the hinged door.

10. The dumpster according to claim 9 wherein the closure opening enables the roll-off dumpster to interface with the stationary compactor; wherein the closure opening enables the stationary compactor to insert compacted material into the interior of the roll-off dumpster.

11. The dumpster according to claim 10 wherein the sliding door is able to move up or down via a winch; wherein a winch cable winds on the winch.

12. The dumpster according to claim 11 wherein the winch cable is affixed to a top door surface of the sliding door in order to raise up or lower down the sliding door with respect to the hinged door thereby exposing or sealing off the closure opening of the hinged door.

13. The dumpster according to claim 12 wherein the front frame extends vertically above the stationary compactor; wherein the front frame is further defined with a top frame; wherein the winch is mounted on the top frame of the front frame.

14. The dumpster according to claim 13 wherein the winch cable includes a hoop that attaches to an eyelet affixed to the sliding door; wherein the eyelet of the sliding door is located on the top surface such that the winch cable is able to pull the sliding door upwardly, and upon releasing of the winch cable via the winch, the sliding door is able to drop.

15. The dumpster according to claim 14 wherein the winch cable is able to be disconnected from the sliding door when the roll-off dumpster is to be taken away from the stationary compactor.

16. The dumpster according to claim 14 wherein the winch is wired to a control module, which in turn is wired to a power source.

* * * * *